US005184778A

United States Patent [19]

Noakes

[11] Patent Number: 5,184,778

[45] Date of Patent: Feb. 9, 1993

[54] ELECTROSTATIC SPRAYING APPARATUS

[75] Inventor: Timothy J. Noakes, Pantymwyn, United Kingdom

[73] Assignee: Imperial Chemical Industries PLC, London, United Kingdom

[21] Appl. No.: 849,351

[22] Filed: Mar. 11, 1992

[30] Foreign Application Priority Data

Mar. 13, 1991 [GB] United Kingdom ..... 9105327

[51] Int. Cl.[5] ..... B05B 5/00

[52] U.S. Cl. ..... 239/691; 239/696; 239/708

[58] Field of Search ..... 239/690, 691, 696, 708, 239/375; 361/227, 228

[56] References Cited

U.S. PATENT DOCUMENTS

| | | | |
|---|---|---|---|
| 2,914,221 | 11/1959 | Rosenthal | 239/690 |
| 3,495,779 | 2/1970 | Renner et al. | 239/690 |
| 4,139,155 | 2/1979 | Hastings | 239/708 |
| 4,306,685 | 12/1981 | Coffee | 239/690 |
| 4,331,298 | 5/1982 | Bentley et al. | 239/690 |
| 4,398,671 | 8/1983 | Coffee | 239/690 |
| 4,401,274 | 8/1983 | Coffee | 239/690 |
| 4,577,803 | 3/1986 | Owen | 239/690 |
| 4,962,885 | 10/1990 | Coffee | 239/690 |
| 4,971,257 | 11/1990 | Birge | 239/708 |

FOREIGN PATENT DOCUMENTS

| | | |
|---|---|---|
| 0163390 | 12/1985 | European Pat. Off. . |
| 2082280 | 12/1971 | France . |
| 0435054 | 10/1967 | Switzerland . |

*Primary Examiner*—Andres Kashnikow
*Assistant Examiner*—Lesley D. Morris
*Attorney, Agent, or Firm*—Cushman, Darby & Cushman

[57] ABSTRACT

An electrostatic spraying apparatus is in the form of a device suitable for hand held use. The device uses a high voltage generator of the rectified pulsed type and includes an earth return path which is completed via the operator through a contact (38) associated with the hand grip (4) of the device. Resistance (36), typically of the order of 50 megohm, suppresses pulsed electrical sensations that may be experienced by the operator in the event that the nozzle (12) is contacted with an earthed object, and the nozzle (12) is designed so that the liquid therein presents, by virtue of the length and cross-sectional area of a liquid conducting passage(s) in the nozzle, a high resistance between the voltage generator (26) and the nozzle thereby reducing the energy that can be drawn to earth by electrical discharge.

14 Claims, 2 Drawing Sheets

ELECTROSTATIC SPRAYING APPARATUS

This invention relates to electrostatic spraying apparatus of the type in which the electrostatic forces are instrumental in controlling formation of the spray, and in particular of the type which do not require a source of pressurised air or gas for contacting and atomising the liquid.

One of the problems of using hand held electrostatic spraying apparatus is to prevent the operator from getting electrical shocks or sensations which can be unpleasant and dangerous. The danger can come from the magnitude of the electrical discharge itself, which if large enough can kill, or from secondary shock hazard when the operator involuntarily reacts which may place him or her in danger. The problem becomes more significant in domestic apparatus which may be used by less experienced people.

The present invention is particularly concerned with, but not necessarily limited to, handheld devices intended for the use by householders, e.g. for the application of personal care products such as perfumes, body sprays etc. or for spray type touch-up paints for cars etc. In the past, such products have often been packaged in containers employing a propellant gas for effecting spraying. In recent times, there has been a trend away from the use of aerosol propellants for environmental reasons and attention has turned to other forms of spraying device. One candidate as a replacement for aerosol sprays is the electrostatic sprayer. However, to secure acceptance by the general public of an electrostatic device as a substitute for a conventional aerosol spray, it is necessary to provide a device which is simple to operate, easy to handle and does not produce electrical shocks or sensations.

It is known from the present Applicant's EP-A-163390 to provide a hand held electrostatic liquid spraying apparatus in which a high voltage generator is used to generate a series of rectified high voltage pulses which are applied to the liquid to produce, with the aid of a field intensifying electrode forming part of the device, electrostatic spraying of the liquid from a nozzle of the apparatus. In such apparatus, the input side of the generator is connected to a low voltage source and a path from the input side of the generator to earth may be provided through the operator via an operating trigger of the apparatus.

Apparatus such as that described in EP-A-163390 is very familiar to the present Applicants and is not suitable for use by domestic householders and other typical users of conventional sprayers employing aerosol propellants because it is not particularly adapted to eliminate or at least suppress the kind of electrical sensations that would not normally concern the kind of person using the apparatus for its intended purpose, i.e. spraying pesticide spraying formulations.

Thus, for example, use of the apparatus of EP-A-163390 could give rise to an electrical shock experienced by the user if the nozzle is brought sufficiently close to an earthed object, such as a plant, to allow a spark discharge to occur. Similarly, if the nozzle is brought close to another person both that person and the operator will experience an electrical shock. In practice, although there may be some discomfort, the shocks experienced would be unlikely to be of a magnitude to concern the agricultural user.

In considering the suitability of the apparatus of EP-A-163390 for domestic householder use, we have also noted another form of electrical sensation that is experienced with this apparatus and which is likely to render such apparatus unacceptable to such users. Because such apparatus uses a generator producing a rectified pulsed high voltage output, the operator may in some circumstances experience a pulsing or throbbing sensation. For example, if the nozzle is actually contacted with an earthed object, an inverted waveform corresponding to the output of the generator appears at the input side of the generator and is sensed by the operator through the earth return contact as a pulsing sensation which to the inexperienced person might be perceived as an unpleasant sensation possibly involving a risk of a shock. A remedy for this is to use a feedback regulated voltage (smoothed) generator; however, such a generator is so much more costly than the simple form of the generator described in EP-A-163390 as to preclude this as a realistic remedy for adoption in an aerosol replacement design where cost must be kept low if the design is to have any prospect of achieving credibility in the market place.

According to the present invention there is provided an electrostatic spraying device comprising:

a nozzle;

means for supplying to the nozzle liquid having a suitable resistivity for electrostatic spraying;

high voltage generator means producing a pulsed output which is applied to the liquid so that liquid discharged from the nozzle is formed into a spray under the influence of electrostatic forces;

means for providing an earth return path from the input side of the generator means through part of the device such that, during handling of the device, the path to earth is completed through the user;

first high resistance means associated with the nozzle whereby the energy which can be drawn to earth, in normal use, from the nozzle in any one discharge is no greater than 0.2 milli Joules; and second high resistance means provided between said part and the input side of the generator means for smoothing the voltage pulses arising at the input side of the generator means in the event of the nozzle being contacted with a low potential such as an earthed object.

According to a second aspect of the invention there is provided a self-contained electrostatic spraying device which is portable as a unit, comprising:

a housing for accommodating a container of liquid suitable for electrostatic spraying and a low voltage source, said housing including a spraying nozzle to which the liquid is supplied in use;

high voltage generator means producing from said low voltage source a pulsed output which is applied to the liquid so that liquid discharged from the nozzle is formed into a spray under the influence of electrostatic forces acting between the nozzle and low potential targets independent of the device;

contact means so located on the housing as to be contacted by the user's hand during handling of the device to provide via the user a path to earth from the input side of the generator means;

first high resistance means associated with the nozzle whereby the energy which can be drawn to earth, in normal use, from the nozzle in any one discharge is no greater than 0.2 milli Joules; and second high resistance means provided between said earth return contact and the input side of the generator means for smoothing the voltage pulses arising at the input side of the generator means in the event of the nozzle being contacted with a low potential such as an earthed object.

The first high resistance means may be presented by the liquid occupying a passage and/or a plurality of capillary paths within the nozzle, such passage or paths being sufficiently long and narrow that the liquid therein constitutes a sufficiently high resistance to limit the energy which can be drawn to earth, in normal use, from the nozzle in any one discharge to no more than 0.2 milli Joules. Such first resistance serves two functions; firstly, it prevents the output side of the generator being dropped to the low potential (e.g. earth) prevailing at the nozzle when the latter is contacted with a low potential object, thereby reducing the voltage peaks that would otherwise be seen at the input side of the generator in such circumstances and, secondly, it limits the discharge experienced by the operator if the nozzle is brought sufficiently close to an earthed object (which might be another person for example) to cause a discharge therefrom. In the latter case, both the operator and the person approached would experience a shock in the absence of any preventive measures. Thus, if in use or by abuse, the nozzle is brought so close to an earthed object as to cause a discharge, the danger associated with the involuntary reaction an electric shock can cause, is largely removed by the provision of said first high resistance means.

The discharge which a person can withstand without involuntary reaction is thought to be subjective to a degree. However, we find satisfactory results are obtained if the discharge is limited to 0.2 milli Joules.

Preferably, the discharge is limited sufficiently that a person cannot feel it through a hand. What a person can feel is also thought to be subjective to a degree. However, we find it satisfactory if the discharge is limited to 0.2 milli Joules, even if some sensitive people may feel that. In general, the discharge cannot be felt by the hand if the discharge is limited to 0.05 milli Joules.

The nozzle is conveniently made of insulating material and the apparatus may include means for making electrical contact between the liquid and one pole of the high voltage supply.

The generator usually produces its high voltage output in the form of pulses, typically with a repetition rate of 5-30 Hz. The second high resistance at the earth return contact, together with the capacitance of the circuit as seen at the earth return contact, serves to smooth the pulses which would otherwise be sensed as an electrical sensation, if, say, the nozzle is earthed, so that any danger that might otherwise be perceived by the inexperienced user is largely removed. In an embodiment, using a generator with an operating voltage of up to 25 KV a value of 50 megohms is usually adequate for said second resistance means.

It will be understood that the selection of said first and second high resistance means in practice has to be made with regard to the voltage drop they create since, for a generator means having a given maximum output voltage under normal spraying conditions, any voltage drop introduced gives rise to a risk of spraying being affected detrimentally or suppressed altogether. This risk may of course be eliminated simply by employing a generator means with a large magnitude output; however, the generator size (in terms of its output) is related to cost and, in order to provide an economical spraying device suitable as an aerosol replacement, generator cost must be kept within reasonable bounds. In practice, we have found that it is possible to achieve a reasonably economical generator cost while realising the objectives specified for the first and second high resistance means by operating within the following constraints (applicable to devices devoid of field intensifying electrodes as discussed below) for liquids having resistivities within the range $5\times10^5$ to $2\times10^7$):

Where the flow rate of the liquid sprayed in use is no greater than 0.01 cc/min, the voltage output of the generator means at the current drawn in normal spraying is no greater than 10 kV.

Where the flow rate of the liquid sprayed in use is within the range 0.01 to 0.1 cc/min, the voltage output of the generator means at the current drawn in normal spraying is no greater than 12 kV.

Where the flow rate of the liquid sprayed in use is within the range 0.1 to 6 cc/min, the voltage output of the generator means at the current drawn in normal spraying is no greater than 20 kV.

Where the flow rate of the liquid sprayed in use is within the range 6 to 12 cc/min, the voltage output of the generator means at the current drawn in normal spraying is no greater than 32 kV.

Preferably the device is so designed that the electrical field strength influencing formation of the spray is substantially independent of any low potential influences of the device. In particular, it is preferred that the device should be devoid of any field intensifying electrode means influencing formation of the spray. This is preferred as a fully effective field intensifying means would have to be located or mounted in such a way as to be obtrusive and, in general, this would be unacceptable in a device for use by the householder or the like. There is a drawback in the omission of a field intensifying electrode in that the presence of such an electrode allows the same spraying efficiency to be achieved using a generator having a lower output voltage. However, despite the presence of the first and second resistance means and the absence of a field intensifying electrode, we have found that it is possible to achieve satisfactory spraying without having to increase the size of the generator unduly.

An embodiment of the invention will now be described, by way of example, with reference to the accompanying drawings, in which.

The invention may be embodied in any shape convenient to the purpose of which it is to be put. The embodiment illustrated is in the form of a spray gun.

Figure 1:
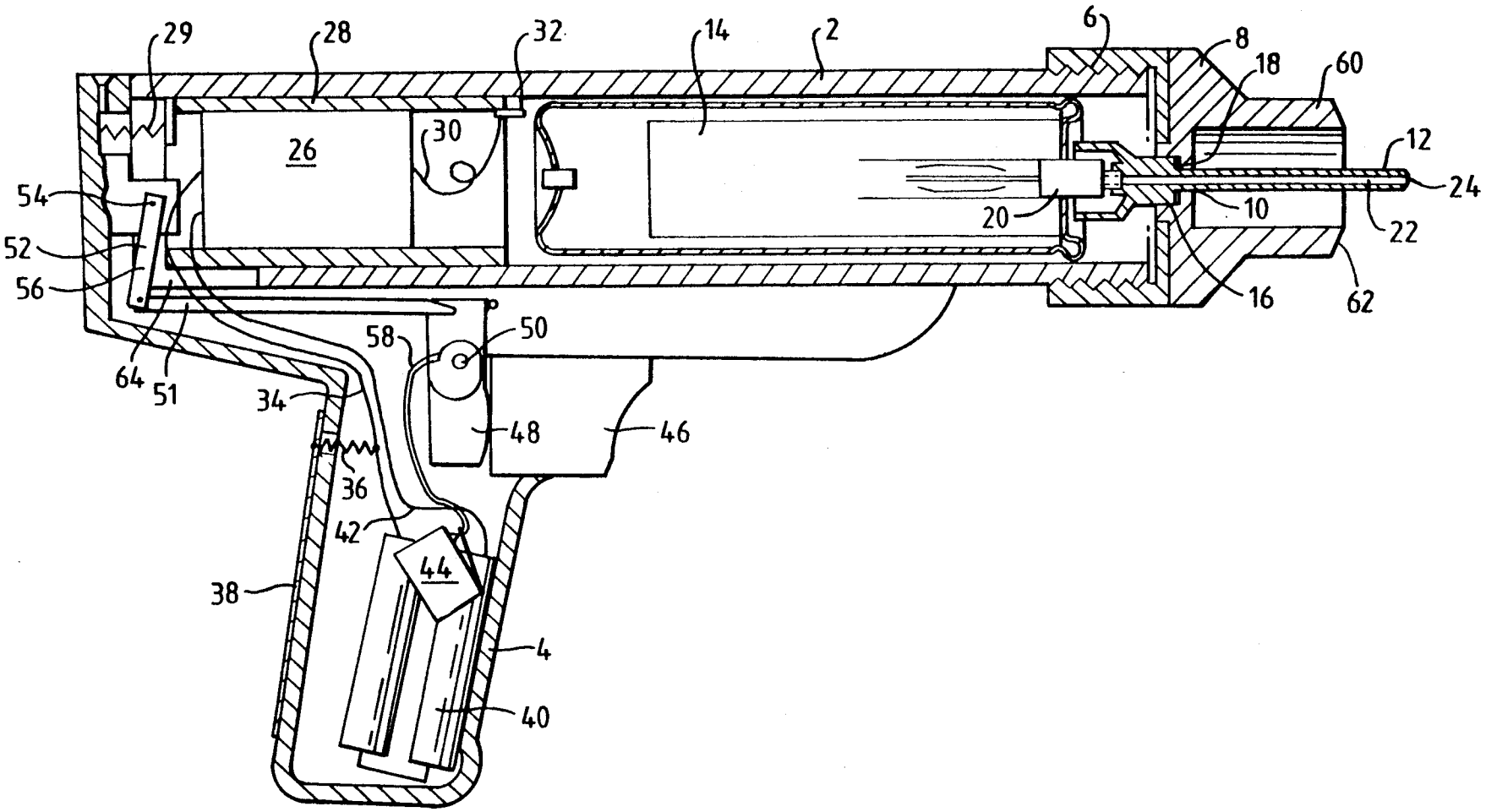
FIG. 1 is a cross section of an electrostatic spray gun embodying the invention.

The spray gun illustrated in FIG. 1 has a body member 2 and a hand grip 4. The body member 2 is in the form of a tube of insulating plastics material.

The body member is externally threaded at its end 6 to receive an end cap 8, which may also be of plastics material selected from the same group. Alternatively the end cap may be of a less insulating material, for example Tufnol Kite brand. The end cap 8 has a central aperture 10 through which, in use, a nozzle 12 projects. Means are provided, in the form of a container 14, for delivering liquid to be sprayed to the nozzle. The nozzle 12, which is permanently attached to the container 14, has a shoulder 16 which is received by a recess 18 on the inside of the end cap, thereby to locate the nozzle accurately centrally of the end cap. The container may be replaced by removing the end cap.

Figure 3:
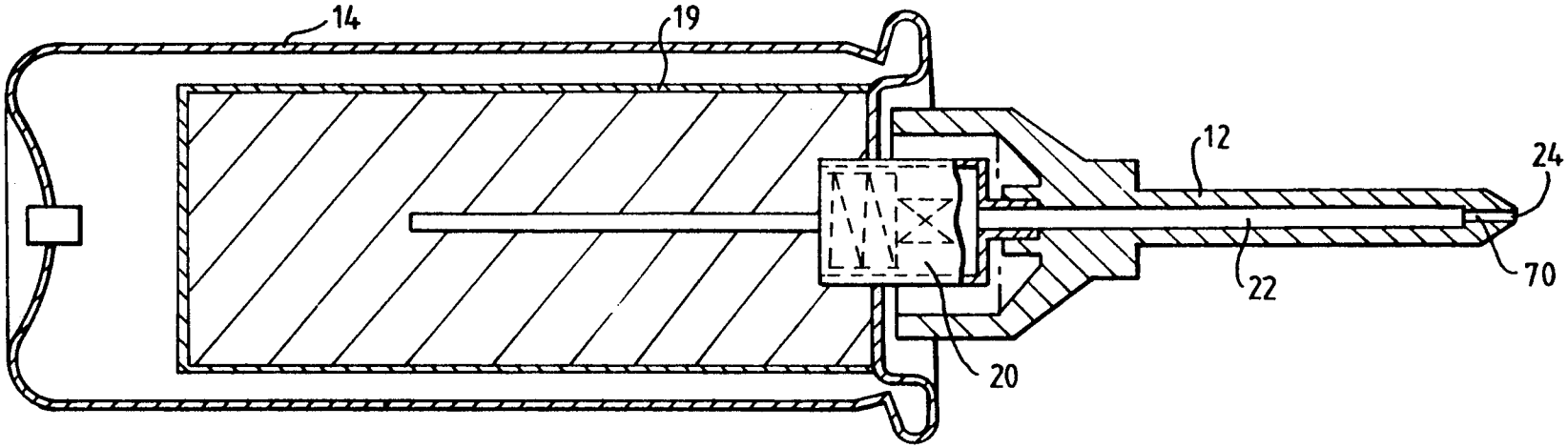
FIG. 3 is a cross section of a container for use in the gun of FIG. 1.

The container is pressurised by a liquefied propellant, e.g. fluorocarbon 134A, which is separated from the liquid to be sprayed by a metal foil sack 19 (FIG. 3). The supply of fluid to the nozzle 12 is switched on and off by a valve 20 with which a passage 22 in the nozzle communicates. As in the case of an aerosol can, pressing the valve 20 relatively towards the container 14 opens the valve allowing liquid to be propelled from the container by the pressurised propellant and into the passage 22 of the nozzle. An internal restriction in the container 14 limits the flow rate to a low value, e.g. 1 cc per minute and so that the liquid arrives at the outlet 24 of the nozzle at very low pressure which is not sufficient to cause any or significant atomisation in the case of non aqueous liquids. The nozzle may be insulating or semi-insulating. It is preferred that the nozzle is insulating being made from a material having a resistivity greater than $10^{14}$ ohm cm. Examples of such materials are ABS, polypropylene, polyethylene, polyvinyl chloride, acrylic, polycarbonate, acetal. Insulating nozzles rely on the liquid to be sufficiently conducting that the voltage drop caused in use by the resistive effect of the liquid is not so great as to reduce the voltage at the nozzle to a value which spoils the quality of, or prevents, spraying. In cases where the liquid has too high a resistivity, the nozzle may be made from a more conducting material so that it acts as a resistor in parallel with the resistance presented by the liquid. In the extreme case of a highly insulating liquid, the material of the nozzle may have a bulk resistivity of $10^7$ ohm cm, the resistivity normally being above this value. Ceramic materials may be made with such values of resistivity. The container 14 is conducting, in this example.

In the example illustrated a single filament or ligament of liquid issues from the tip of the nozzle. In other examples, the nozzle may be annular or in the shape of a plane blade so that a plurality of ligaments of liquid issue therefrom.

At the end of the body member 2 remote from the nozzle 12, a high voltage generator 26 is situated in a tubular carriage 28. The high voltage generator is of the type which produces a rectified pulsed output and is conveniently of the form described in our prior European Patent Application No 163390. Such generators, having no voltage regulation by means of feedback control, are inexpensive to manufacture and, whilst the output thereof is of a pulsed, spiky nature, this is usually acceptable for electrostatic spraying devices which produce droplets by way of single ligaments. The carriage 28 is slidable in the body member 2 and is biased away from the end cap 8 by a tension spring 29. The generator has a high voltage output pole 30 connected to a contact schematically indicated at 32 for contact with the conducting container 14. The other high voltage output pole is electrically common with a low voltage supply lead 34 and thus connected via a resistor 36 to a contact strip 38 on the exterior of the hand grip 4. The low voltage supply lead is connected to one pole of a battery 40. The other pole of the battery is connected to the generator by another low voltage supply lead 42 via a microswitch 44.

The valve 20 is opened, in use, by relative movement between the container 14 and the body 2, the nozzle 12 remaining fixed in relation to the body. Movement to operate the valve is applied to the container by movement of the generator. To this end, the grip 4 has a trigger 46 which when squeezed operates on one end of a lever 48 which is pivotally mounted at 50. Movement of the lever 48 is communicated by a link 51 to a further lever 52 which is pivotally mounted at one end 54. A central position 56 of the lever 52 bears on the end of the carriage, and thus the container, towards the nozzle, so opening the valve 20. As this happens a linkage 58 operates the microswitch 44 so that power is supplied to the generator. The high voltage output from the generator is thus applied to the container and so to the liquid therein. The high voltage is thus conducted to the tip of the nozzle, via the liquid in the case of an insulating nozzle, where the electric field strength is sufficient to produce a charged spray. In the case of a semi insulating nozzle, the nozzle itself contributes to the conduction.

The spray may be formed preponderantly by electrostatic forces, suitable liquids for such operation preferably having a resistivity in the range from $1\times10^5$ up to $5\times10^{10}$ ohm cm (more usually no greater than $1\times10^8$ ohm cm) in the case of non-aqueous liquids. In the case of more conducting liquids and aqueous liquid systems, a weak jet may be produced by hydraulic pressure, even in the absence of the high voltage, which jet breaks up into coarse droplets. The addition of the high voltage creates an electric field which accelerates the jet (as in the case of more resistive liquids), causes the jet to neck thereby improving the spray by substantially decreasing the droplet size and, since like charges repel each other, spreads the spray out into a cloud.

The end cap 8 has an annular shroud 60 also formed of insulting material. In initial operation of the spray gun small amounts of charge accumulate on the outer edge 62 of the shroud. As the shroud is insulating, e.g. being made of a non-conducting material, e.g. Tufnol, ABS, polypropylene, polyethylene, polyvinyl chloride, acrylic, polycarbonate, acetal, and supported on the insulating body 2 leakage is sufficiently slow as to leave the shroud charged. The charge on the edge is of the same polarity as the spray which it thus repels. This reduces the tendency of the spray to lift or spread out. The shroud 60 can thus be used to control the shape of the spray and to this end may be adjustable or there may be several different interchangeable shrouds.

Figure 2:
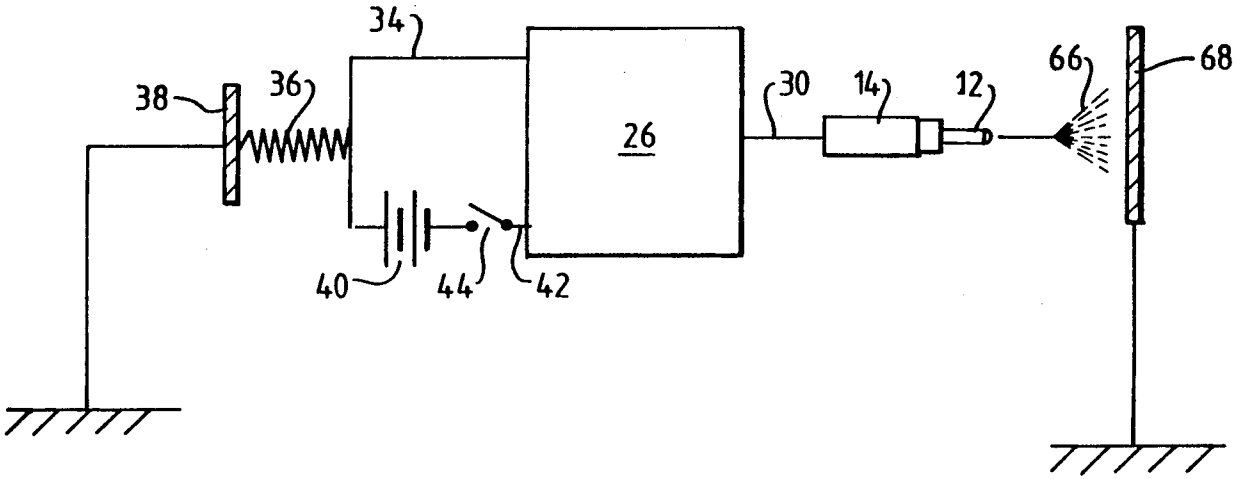
FIG. 2 is a diagram of the high voltage circuit of the gun of FIG. 1.

In use the grip is held in a hand and the trigger is squeezed as explained above. The hand contacts the conducting strip 38 to provide an earth return circuit. The high voltage circuit is shown in FIG. 2. The contact strip 38 is connected via a person (the operator of the gun) to ground. In normal use the current through the operator is too small to feel or to pose any kind of danger. The generator high voltage output has two poles, one in common with a low voltage input pole on lead 34 is connected via a resistor 36 to the contact strip 38. The other on lead 30 is connected to the container 14 and so via the liquid therein to the tip of the nozzle 12. Liquid issues from the nozzle in the form of a filament or ligament which breaks up into a spray of charged droplets 66. These are attracted to an earthed object 68, which may be an intended or unintended target. Earth completes the circuit through the operator.

If when the apparatus is being used, the user moves the nozzle into close proximity to an earthed object (which might be inanimate or another person) such that a discharge can occur, since the nozzle is insulated there is only a circuit via the liquid in the nozzle. In relation to the capacitance of the electrical circuit as seen at the nozzle outlet, the series resistance at the outlet should be large enough to limit energy which can be drawn to earth in any one discharge to below a level which causes the operator and/or other person to react involuntarily to a significant extent. In the case of a less insulating nozzle the combined effect of the nozzle and the liquid therein constitutes the series resistance seen at the nozzle. In the embodiment illustrated a suitable high resistance is provided between the large capacitance provided by the metal container and liquid contents, on the one hand, and the nozzle tip, on the other hand, by the liquid in the passage 22. To this end the passage 22 is sufficiently long and narrow that, for the resistivity of the liquid in the container, the liquid in the passage presents a suitably high resistance. In the embodiment illustrated, the passage through the nozzle is about 50 mm long over all. The main diameter is 3 mm and there is a 5 mm long section 70 at the outlet 24 where the diameter is reduced to 0.6 mm.

In the case of aqueous liquid systems the resistance of the path 22 can be increased by reducing the diameter of the section 70 still further to say 150 microns.

In other embodiments, not illustrated, the nozzle is formed of a porous material similar to that used for the writing element in a felt tip pen. The container may not then need to be pressurised, supply of liquid to the nozzle relying on capillary action. The multiple capillary paths provided for liquid by such a nozzle also are required to be sufficiently long and narrow that their combined effect is a resistance which is sufficiently large as to limit the discharge to earth.

The discharge which a person can withstand without involuntary reaction is thought to be subjective to a degree. However, we find satisfactory results are obtained if the maximum discharge which can be drawn to earth is limited to 0.2 milli Joules.

Preferably, the discharge is limited sufficiently that a person cannot feel it through a hand. In general, the discharge cannot be felt by the hand if the discharge is limited to 0.05 milli Joules.

If, in use or by abuse, the nozzle of the gun is touched on an earthed object the nozzle is brought to earth potential. If the earth return path is, as illustrated, via a person, the earth return contact will have presented to it high voltage pulses of the opposite polarity to those which would normally occur at the nozzle and the user may perceive a pulsing electrical sensation. This pulsing is smoothed with the aid of the resistor 36.

The pulsed voltage which a person can perceive as a tactile sensation through the hand is thought to be subjective to a degree. However, we find that the electrical sensation can be adequately suppressed for most individuals if, for a generator which is unregulated and produces about 0.5 microamps at about 15 kV, the resistor 36 has a value of at least 10 megohms and more preferably at least 50 megohms even if some sensitive people may still be able to perceive a slight sensation with that.

To further exemplify the invention, in one embodiment employing a nozzle design in accordance with FIG. 3 and devoid of an earthed field intensifying electrode, satisfactory spraying, with good suppression of electrical shock at the nozzle and pulsing sensation at the hand grip, was obtained using a liquid having a resistivity of $5\times10^6$ ohm cm, viscosity of 2 poise and flow rate of 3 cc/min; in this embodiment, the generator produced an output of 17 kV at the current drawn during normal spraying (about 0.3 micro Amps), the resistor 36 had a value of 10 megohm and the insulating nozzle had the following dimensions:

exit passage 70: diameter 800 microns, length 5 mm;
passage 22: diameter 2 mm, length 2 cm.

The resistance provided by the liquid column occupying the nozzle passages 22 and 70 can be shown by calculation to be of the order of 800 megohm and was effective to limit any one discharge to earth (when the nozzle was brought into close proximity with an earthed object) to well below 0.05 milli Joules and a resistance of 10 megohm (as resistor 36) was found to be sufficient to effectively eliminate any subjectively detectable pulsing sensation at the handgrip.

It will be appreciated that, in practice, the dimensions of the nozzle passages 22, 70 and the selection of the value of the resistor 36 have to be made with regard to the magnitude of voltage drop that can be tolerated, especially when, for cost reasons, the generator size is to be kept small (both in terms of physical size and output voltage generated at normal spraying currents). The resistivities of the liquids to be used with the device also have to be taken into consideration as the resistance presented by the liquid column within the nozzle passages is governed by the resistivity of the liquid. It is envisaged that devices in accordance with the invention will be used for specific liquid compositions in which case the device can be designed for use with a liquid having a fairly narrow resistivity range, it being necessary usually for a given liquid formulation to make some allowance for variation in resistivity. For example, the resistivity of the liquid formulation may vary with shelf life and the extent of the variation should therefore be taken into account by designing the nozzle so that the liquid column presents adequate resistance for shock suppression purposes over the range of variation in resistivity that can be expected for a particular liquid formulation.

Although the invention is illustrated in the accompanying drawings by way of a handheld device, it also extends to devices which, though not intended to be used to effect spraying while held in the hand, are nevertheless portable and may be handled while spraying. For instance, the invention may be embodied in a room freshening device for spraying fragrance into the air, the device being adapted for location on a horizontal surface, such as a shelf, or for mounting on a wall. Such a device will comprise a nozzle, liquid supply container, high voltage generator, and low voltage supply circuit generally arranged in the same manner as in the illustrated embodiment but embodied in a housing suitable for surface mounting or arranged to be free standing. In this event, the nozzle may be of a wick-type material so designed as to provide sufficient resistance when impregnated with liquid to limit any one discharge to earth to no more than 0.2 milli Joules. Also, the housing will include for instance a contact plate, e.g. on its base in the case of a free-standing device, for providing an earth return path from the input side of the generator through the surface on which the housing stands. A resistance for suppressing the previously described pulsing sensation is provided between the contact plate and the input side of the generator so that, if the device is handled while it is operating in the spraying mode, the user will not sense the pulsing sensation in circumstances where the contact plate is touched with the nozzle in contact with an earthed object.

In a further modification of the invention, the liquid may be contained in a collapsible container such as a sachet and may be dispensed in the manner described in our copending European Patent Application No 91309472.8 the disclosure of which is incorporated herein by reference. Briefly the device includes a mechanism for compressing the sachet in response to operation of the trigger (which operation also energises the generator to produce the high voltage output) so as to supply the liquid to the nozzle outlet.

I claim:

1. An electrostatic spraying device comprising:

a nozzle;

means for supplying to the nozzle liquid having a suitable resistivity for electrostatic spraying;

high voltage generator means producing a pulsed output which is applied to the liquid so that liquid discharged from the nozzle is formed into a spray under the influence of electrostatic forces;

means for providing an earth return path from the input side of the generator means through part of the device such that, during handling of the device, the path to earth is completed through the user;

first high resistance means associated with the nozzle whereby the energy which can be drawn to earth, in normal use, from the nozzle in any one discharge is no greater than 0.2 milli Joules; and second high resistance means provided between said part and the input side of the generator means for smoothing the voltage pulses arising at the input side of the generator means in the event of the nozzle being contacted with a low potential such as an earthed object.

2. A self-contained electrostatic spraying device which is portable as a unit, comprising:

a housing for accommodating a container of liquid suitable for electrostatic spraying and a low voltage source, said housing including a spraying nozzle to which the liquid is supplied in use;

high voltage generator means producing from said low voltage source a pulsed output which is applied to the liquid so that liquid discharged from the nozzle is formed into a spray under the influence of electrostatic forces acting between the nozzle and low potential targets independent of the device;

contact means so located on the housing as to be contacted by the user's hand during handling of the device to provide via the user a path to earth from the input side of the generator means;

first high resistance means associated with the nozzle whereby the energy which can be drawn to earth, in normal use, from the nozzle in any one discharge is no greater than 0.2 milli Joules; and second high resistance means provided between said earth return contact means and the input side of the generator means for smoothing the voltage pulses arising at the input side of the generator means in the event of the nozzle being contacted with a low potential such as an earthed object.

3. A device as claimed in claim 1 or 2 in which the electric field strength influencing formation of the spray is substantially independent of any low potential influences from the device.

4. A device as claimed in claim 1 or 2 in which the device is devoid of any field intensifying electrode means influencing formation of the spray.

5. A device as claimed in claim 1 or 2 in which first high resistance means is constituted by a body of said liquid terminating at the nozzle outlet whereby the energy which can be drawn to earth, in normal use, from the nozzle in any one discharge is no greater than 0.02 milli Joules (preferably no greater than 0.05 milli Joules).

6. A device as claimed in claim 1 or 2 in which the nozzle is made of an electrically insulating material, means being provided for making electrical contact between the output of the generator means and the liquid, said first resistance means being constituted substantially entirely by a body of said liquid terminating a the nozzle outlet.

7. A device as claimed in claim 1 or 2 in which the nozzle comprises a passage of reduced cross-section for accommodating said column of liquid.

8. A device as claimed in claim 7 in which said passage comprises two sections, one section immediately adjacent the nozzle outlet being narrower than the section upstream thereof.

9. A device as claimed in claim 1 or 2 in which said second high resistance means has a value of at least 10 megohms, and preferably at least 50 megohms.

10. A device as claimed in claim 1 or 2 in which the flow rate of the liquid sprayed in use is no greater than 0.01 cc/min and the voltage output of the generator means at the current drawn in normal spraying is no greater than 10 kV.

11. A device as claimed in claim 1 or 2 in which the flow rate of the liquid sprayed in use is within the range 0.01 to 0.1 cc/min and the voltage output of the generator means at the current drawn in normal spraying is no greater than 12 kV.

12. A device as claimed in claim 1 or 2 in which the flow rate of the liquid sprayed in use is within the range 0.1 to 6 cc/min and the voltage output of the generator means at the current drawn in normal spraying is no greater than 20 kV.

13. A device as claimed in claim 1 or 2 in which the flow rate of the liquid sprayed in use is within the range 6 to 12 cc/min and the voltage output of the generator means at the current drawn in normal spraying is no greater than 32 kV.

14. A device as claimed in claim 1 or 2 in which the first and second resistance means have values such that the device is effective to spray non-aqueous liquids having resistivities within the range from $1\times10^5$ up to $5\times10^{10}$ ohm cm (preferably up to $1\times10^8$ ohm cm).

* * * * *